United States Patent [19]

Narasimhan et al.

[11] Patent Number: 5,055,146

[45] Date of Patent: Oct. 8, 1991

[54] PERMANENT MAGNET ALLOY

[75] Inventors: Kalathur S. V. L. Narasimhan, Monroeville; Bao-Min Ma, Pittsburgh, both of Pa.

[73] Assignee: Crucible Materials Corporation, Pittsburgh, Pa..

[21] Appl. No.: 364,519

[22] Filed: Jun. 9, 1989

Related U.S. Application Data

[63] Continuation of Ser. No. 629,389, Jul. 10, 1984, abandoned.

[51] Int. Cl.[5] ..... C22C 38/40

[52] U.S. Cl. ..... 148/302; 420/83; 420/121

[58] Field of Search ..... 148/302; 420/83, 121

[56] References Cited

U.S. PATENT DOCUMENTS

| | | | |
|---|---|---|---|
| 4,684,406 | 8/1987 | Matsuura et al. | 420/83 |
| 4,792,368 | 12/1988 | Sagawa et al. | 148/302 |
| 4,840,684 | 6/1989 | Fujimura et al. | 148/302 |

FOREIGN PATENT DOCUMENTS

| | | | |
|---|---|---|---|
| 0101552 | 2/1984 | European Pat. Off. | 148/31.57 |
| 57-57854 | 4/1982 | Japan | 148/31.57 |
| 8000212 | 4/1981 | PCT Int'l Appl. | 148/31.57 |

OTHER PUBLICATIONS

Croat et al., "Proceedings of the 29th Annual Conference on Magnetism and Magnetic Materials", Journal of Applied Physics, vol. 55, No. 6, Part II, Nov. 8–11, 1983, pp. 2078–2082.

Sagawa et al., "Proceedings of the 29th Annual Conference on Magnetism and Magnetic Materials", Journal of Applied Physics, vol. 55, No. 6, Part II, Nov. 8–11, 1983, pp. 2083–2087.

*Primary Examiner*—Deborah Yee

*Attorney, Agent, or Firm*—Finnegan, Henderson, Farabow, Garrett & Dunner

[57] ABSTRACT

A permanent magnet alloy characterized by increased Curie temperature which is achieved by including nickel and cobalt in combination with at least one rare earth element neodymium and mischmetal in combination with iron and boron. Specifically, the alloy contains, in atomic percent, 10 to 20 mischmetal and/or neodymium, 2 to 30 nickel and/or cobalt, 2 to 14 boron and balance iron.

1 Claim, 1 Drawing Sheet

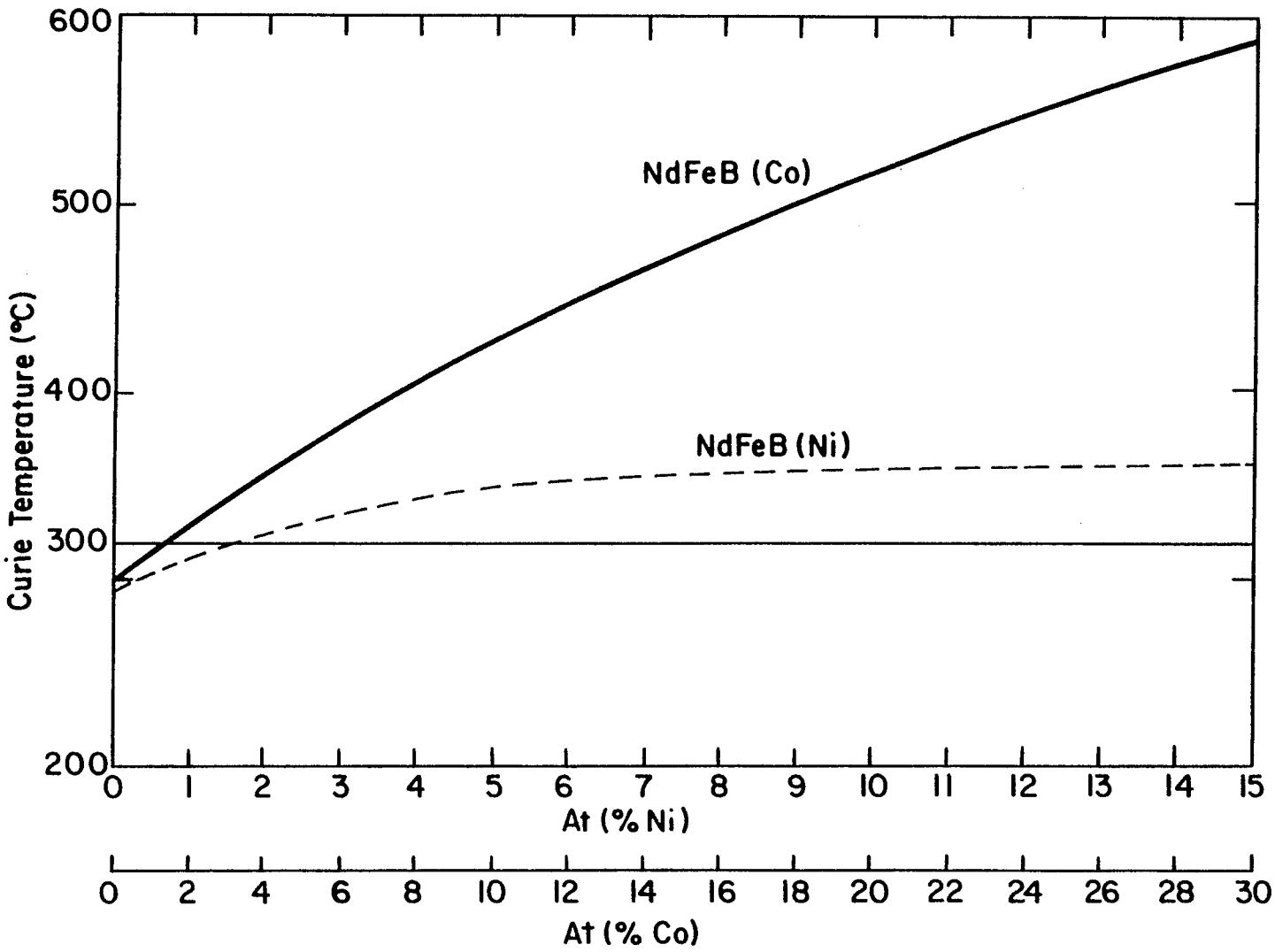
Curie Temperature (°C)
600
500
400
300
200
NdFeB (Co)
NdFeB (Ni)
0 1 2 3 4 5 6 7 8 9 10 11 12 13 14 15
At (% Ni)
0 2 4 6 8 10 12 14 16 18 20 22 24 26 28 30
At (% Co)

PERMANENT MAGNET ALLOY

The Government has rights in this invention pursuant to Contract N00014-81-C-0805, awarded by the Department of the Navy.

This application is a continuation of application Ser. No. 629,389, filed July 10, 1984, now abandoned.

Permanent magnets when used in applications such as electrical motors require relatively high Curie temperatures (Tc) to permit the magnets to function in high temperature applications. For this purpose Curie temperatures of at least about 310° C. are necessary. Permanent magnet alloys containing a rare earth element such as neodymium or mischmetal in combination with iron are known but these cannot achieve the required Curie temperature necessary for use of the magnets in conventional high-temperature applications. If boron is added for this purpose, the Curie temperature is increased but not to the required level.

It is accrordingly a primary object of the present invention to provide a magnet alloy containing at least one rare-earth element and a Curie temperature above 310° C.

This and other objects of the invention, as well as a more complete undestanding thereof, may be obtained from the following description, specific examples and drawing:

The single FIGURE is a graph showing the effect of nickel and cobalt additions on the Curie temperature of neodymium-iron-boron permanent magent alloys.

Broadly, in accordance with the invention the permanent magnet alloy consists essentially of, in atomic percent, neodymium and mischemetal within the range of 10 to 20. If neodymium or mischmetal are used alone they may be within the range of 12 to 18%. Nickel and cobalt may be present within the range of 2 to 30. If nickel is used alone it is within the range of 2 to 15 and if cobalt is used alone it is present within the range of 2 to 30. Boron is present within the range of 2 to 14. The major alloying constituent constituting the balance of the alloy is iron.

To demonstrate the inventon from the standpoint of Curie temperatures achieved in accordance with the practice of the invention the alloys, all of which contain neodymium and iron, set forth in Table I were melted and premanent magnets were produced for testing to determine the Curie temperature. The magnets were produced by melting the elements in their stoichiometric proportions and casing in copper molds. The cast alloys were crushed to 5 to 10 micron size, oriented in a magnetic field, pressed and sintered at 1000°-1100° C.

TABLE I

| Alloy | | |
|---|---|---|
| Molecular Formula | Atomic Percent | $T_c$ (°C.) |
| $NdFe_7$ | Nd = 12.5 Fe = 87.5 | 57 |
| $NdFe_7B_{0.33}$ | Nd = 12 Fe = 84 B = 4 | 299 |
| 1*$NdFe_6NiB_{0.33}$ | Nd = 12 Fe = 72 Ni = 12 B = 4 | 358 |
| $NdFe_{6.4}B$ | Nd = 12 Fe = 76 B = 12 | 295 |
| 2*$NdFe_6Ni_{0.4}B$ | Nd = 11.9 Fe = 71.4 Ni = 4.8 B = 11.9 | 345 |
| $NdFe_{5.13}B_{0.53}$ | Nd = 15 Fe = 77 B = 8 | 304 |
| 3*$NdFe_{4.46}Co_{0.66}B_{0.53}$ | Nd = 15 Fe = 67 Co = 10 B = 8 | 424 |
| 4*$NdFe_{3.8}Co_{1.33}B_{0.53}$ | Nd = 15 Fe = 57 Co = 20 B = 8 | 518 |
| 5*$NdFe_{3.13}Co_2B_{0.53}$ | Nd = 15 Fe = 47 Co = 30 B = 8 | 582 |

As may be seen from Table I only the magnets containing either cobalt or nickel in combination with neodymium, iron and boron exhibit Curie temperature above the required value of 310° C. In addition, it may be seen from Table I that the Curie temperature increased with increased additions of nickel and cobalt. The Curie temperature test results of Table I for both nickel and cobalt containing alloys are graphically presented in the Figure.

The meschmetal containing alloys of Table II were melted and prepared in the manner similar to the magnets of Table I.

TABLE II

| Alloy | | |
|---|---|---|
| Molecular Formula | Atomic Percent | Curie Temperature |
| MM*$Fe_{5.26}B_{0.4}$ | MM = 15 Fe = 79 B = 6 | 242° C. |
| MM $Fe_{5.26}B_{0.4}$ | MM = 15 Fe = 79 B = 6 | 228° C. |
| MM*$Fe_{4.6}Co_{.66}B_{0.4}$ | MM = 15 Fe = 69 Co = 10 B = 6 | 352° C. |
| MM $Fe_{4.6}Co_{.66}B_{0.4}$ | MM = 15 Fe = 69 Co = 10 B = 6 | 326° C. |

*La/Ce ratio in MM = 1.41; MM = 0.5

These alloys were also tested to determine Curie temperature. Like the neodymium containing alloys of Table I only the mischmetal-iron-boron alloys containing cobalt exhibited adequate Curie temperature.

The beneficial effect of additions of cobalt and nickel were also demonstrated for these magnets, as shown in Table III, when tested for anisotropy or magnetic alignment. The results of these tests are set forth in Table III.

TABLE III

| Alloy | | Anisotropy Field, |
|---|---|---|
| Molecular Formula | Atomic Percent | $H_A$ |
| $NdFe_{6.4}B$ | Nd = 12 Fe = 76 B = 12 | 52,000 Oe |
| 6*$NdFe_{6.4}NiB$ | Nd = 10.6 Fe = 68 Ni = 10.6 B = 10.6 | 60,000 Oe |
| $NdFe_{5.13}B_{0.53}$ | Nd = 15 Fe = 77 B = 8 | 45,000 Oe |
| 7*$NdFe_{4.46}Co_{0.66}B_{0.53}$ | Nd = 15 Fe = 67 Co = 10 B = 8 | 64,000 Oe |
| 8*$NdFe_{3.8}Co_{1.33}B_{0.53}$ | Nd = 15 Fe = 57 Co = 20 B = 8 | 49,000 Oe |

With these alloys of Table III the magnetic alignment was improved by the addition of either nickel or cobalt to the neodymium-iron-boron alloy.

We claim:

1. A permanent magnet alloy consisting essentially of, in atomic percent, a rare earth element selected from the group consisting of neodymium and mischmetal 10 to 20, nickel 2 to 15, boron 2 to 14 and balance iron.

* * * * *